United States Patent [19]

Polidori

[11] 4,114,977

[45] Sep. 19, 1978

[54] SINGLE WEDGE-TYPE GRID WIRE CONNECTOR

[75] Inventor: Mario Polidori, Pennsauken, N.J.

[73] Assignee: UTM Power Products, Inc., Westmont, Ill.

[21] Appl. No.: 795,178

[22] Filed: May 9, 1977

[51] Int. Cl.[2] ..... H01R 7/06

[52] U.S. Cl. ..... 339/270 R; 403/390

[58] Field of Search ..... 339/264 R, 264 L, 270 R, 339/273 R, 273 F; 403/390, 395, 398, 399

[56] References Cited

U.S. PATENT DOCUMENTS

| | | | |
|---|---|---|---|
| 2,857,188 | 10/1958 | Fougerolles | 403/398 |
| 4,027,939 | 6/1977 | White | 339/270 R |

FOREIGN PATENT DOCUMENTS

| | | | |
|---|---|---|---|
| 609,207 | 9/1960 | Italy | 403/395 |

*Primary Examiner*—Joseph H. McGlynn
*Attorney, Agent, or Firm*—Lawrence S. Cohen

[57] ABSTRACT

A connector for joining two grounding grid-wire at their node point includes a C-shaped body member, a nesting member shaped like a cross, and a wedge member mounted for movement within the body member. The body member has two spaced apart fingers that straddle one conductor and hook onto the other conductor. The fingers are joined together by a yoke section. The nesting member has crossing depressions on opposite sides and is inserted between the conductors so that they seat on the depressions. The wedge member is mounted beneath the yoke section and screw driven between the yoke section and the straddled conductor to securely join the conductors together within the connector in nested relation.

12 Claims, 15 Drawing Figures

SINGLE WEDGE-TYPE GRID WIRE CONNECTOR

BACKGROUND OF THE INVENTION

This invention relates to electrical connectors and more particularly to an improved connector for joining two conductors extending transversely to one another at different levels and which cross one another defining a node point.

Grounding grids are used in electrical power installations where large amounts of electrical current are used or distributed, including utility generating stations and substations, and heavy industrial installations, such as refineries, chemical plants and steel mills. Grounding grids function to quickly and effectively dissipate surges of fault current so as to limit the potential damage of equipment and protect personnel close to the equipment.

Grounding grids consist of a matrix or crossover network of unjacketed, standard copper cable conductors buried underground or embedded in concrete and connected to above ground equipment by copper leads and to driven ground rods of copper-clad steel. At each cross-over point of the conductors or node of the matrix, a connection has to be made that is mechanically and electrically sound and reliable.

There are in common usage, three readily identifiable methods of connecting the grid conductors. One method involves the use of exothermic welding by which the two conductors are placed in a graphite mode to weld them together. One of the problems with this method is the requirement for a large inventory of graphite molds of different sizes to handle all the different possible combinations of conductor sizes, since one mold handles only one unique combination. Another problem is that of poor welds caused by worn molds allowing the molten metal to flow out of the weld area. Yet another problem is the possibility of initiating such a connection when moisture is present in the mold. In such event, the moisture may be converted by the molten metal to bubbling steam which can cause expulsion of the metal from the top of the mold.

A second method of connecting the conductors is with the use of compression connectors. This method requires an assortment of dies and tools to be used in installing the connectors by a crimping operation. A worn die, an improperly sized die, or an improperly functioning tool can cause failure of a joint due to poor crimping. Also, since the connector is deformed around the conductor, it must be constructed of a material with sufficiently low yield strength. Furthermore, after the crimping operation, the material of the connector tends to spring back away from intimate contact with the conductor. Also, since the connector must be applied at a point remote from the ends of a conductor, the barrel of the connector must be open on one side to allow the conductor to enter the connector barrel before crimping. This weakens the design after crimping in its ability to maintain a good contact force.

A third method of connecting the conductors is through the use of bolted connectors. This general class of connectors relies specifically on the torque-tension relationship of threaded fasteners to produce a clamping force. This type also relies on the inherent strength of the bolt to resist yielding during its service life. The bolt must be properly torqued to provide the correct clamping force.

SUMMARY OF THE INVENTION

In accordance with the invention, a connector for joining two conductors extending transversely to one another comprises a body member, a nesting member for positioning the two conductors within the body member, and a movable wedge member for wedging the conductors in nested relation within the body member.

The body member is generally C-shaped and includes a pair of fingers openly spaced apart at one end for straddling a first one of the conductors. At the openly spaced apart end, the fingers are curved or otherwise shaped to form hook-like seating surfaces for grasping the second conductor extending transversely of the first conductor. The fingers are joined at the other end by a yoke section.

The nesting member is formed with two oppositely facing seating surfaces, or depressions, extending transversely to one another and adapted to be positioned between the two conductors so that the conductors nest in the seating surfaces.

The wedge member is mounted to the yoke section so that it can wedge into the space between the yoke section and the first conductor. The lower surface of the wedge member is formed with a seating surface or depression to fit over the first conductor.

The wedge member is preferably driven by a screw means coupled to the yoke section so that the conductors are secured in their seats in nested relation between the wedge member and the hook-like ends of the fingers.

DESCRIPTION OF THE PREFERRED EMBODIMENT

Figure 1:
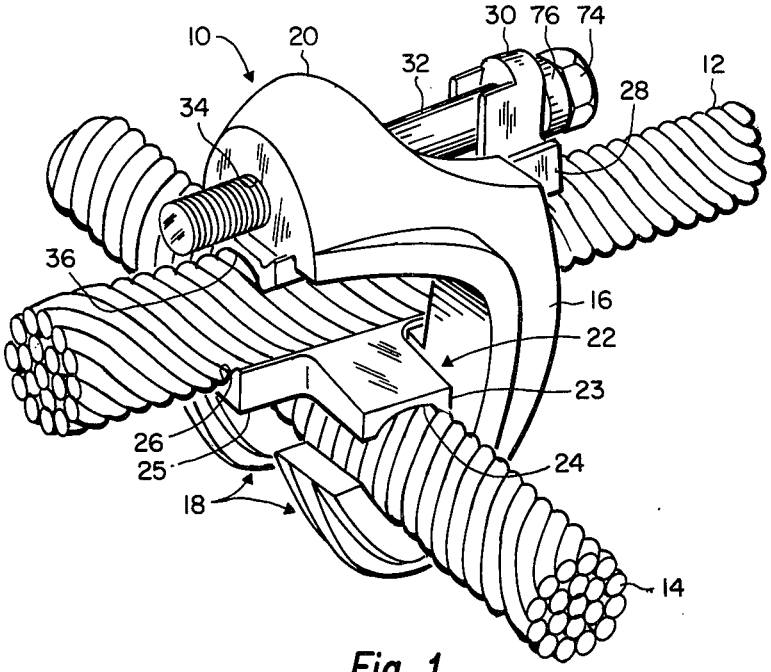
FIG. 1 is a perspective view showing a connector constructed according to the invention and assembed on a pair of grid wires.

Referring now to FIG. 1, there is shown a perspective view of a grid-wire connector 10 installed at one of the nodes of cross-over joints of a grounding grid-wire matrix. At the node of the grid-wire matrix there is a first conductor 12 positioned above and crossing perpendicular to a second conductor 14.

Figure 2:
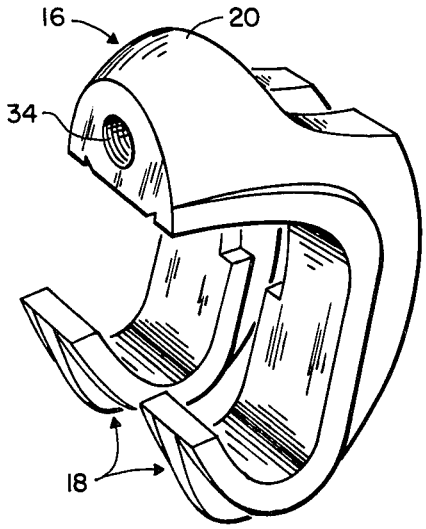
FIG. 2 is a perspective view of a body member of the connector shown in FIG. 1.

The connector 10 comprises a C-shaped body member 15, also shown in FIG. 2, having a pair of fingers 18 openly spaced apart at their lower end and joined together at their upper end by a yoke section 20, and straddling the upper positioned or first conductor 12. The lower ends of the fingers 18 are curved to form hook-like members for grasping the lower positioned or second conductor 14 at spaced points along the latter. The first conductor 12 is straddled by the fingers 18 adjacent the yoke section 20.

Figure 3:
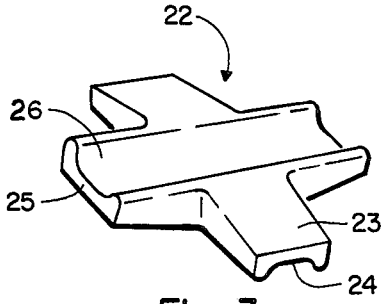
FIG. 3 is a perspective view of a nesting member of the connector shown in FIG. 1.

A nesting member 22 is situated between and separates the two conductor 12 and 14. The nesting member 22, also shown in FIG. 3, is shaped like a cross and has a first cross piece 23 formed with a lower facing depression or seating surface 24 curved concave and forming a saddle or seat for the lower second conductor 14. Similarly, a second cross-piece 25 of the nesting member 22 has an upper depression or seating surface 26 extending perpendicular to the lower seating surface 24 and also curved concave to form a seat for the upper first conductor 12. The length of the cross-pieces 23 and 25 are comparable to the over-all width of the body member 15 including the two finger 18. Preferably the width of each cross piece 23, 25 is slightly less than the inner-edge-to-edge spacing between the fingers 18 so that each of the four projecting ends of the nesting member 22 can fit between the fingers 18. By this means the nesting member 22 may be fitted with regard to selecting a particular crosspiece orientation.

Figure 4:
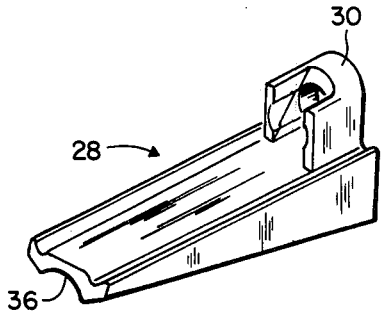
FIG. 4 is a perspective view of a wedge member of the connector shown in FIG. 1.
Figure 5:
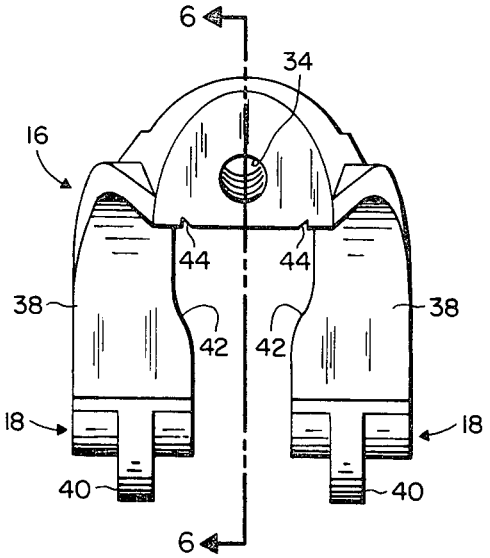
FIG. 5 is a front view of the body member.
Figure 6:
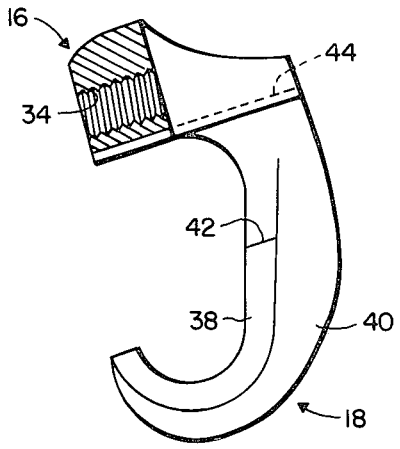
FIG. 6 is a section taken along line 6—6 of FIG. 5.
Figure 7:
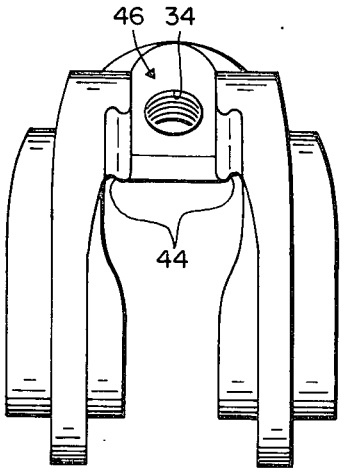
FIG. 7 is a rear view of the body member.
Figure 8:
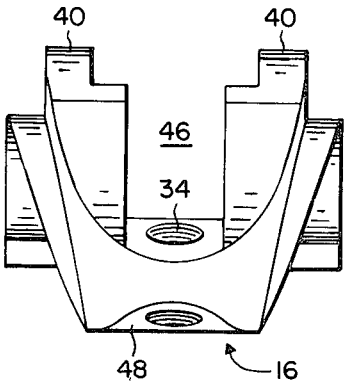
FIG. 8 is a top view of the body member.

An elongated wedge member 28 is positioned beneath the yoke section 20 between the upper portions of the fingers 18 and extends over the first conductor 12. The wedge member 28, also shown in FIG. 4, is tapered in thickness and is mounted for movement in the space between the yoke section 20 and the first conductor 12. The wedge member 28 is provided at the rear, thick end with a collar 30.

A screw driving means for moving the wedge member 28 includes a threaded bolt 32 which is strung through the collar 30 and screwed into a threaded bore 34 in the yoke section 20, so that the wedge member 28 is suspended beneath the yoke section 20. The bottom side of the wedge member 28 has a central portion or depression 36 extending longitudinally and curved concave so that it can fit around the upper portion of the first upper conductor 12 when the wedge member 28 is screw driven through the opening between the fingers 18 of the body member 15. When the tapered end of the wedge member 28 is driven forward along the surface of the first conductor 12 and into the space between the yoke section 20 and the first conductor 12, it squeezes the two crossing conductors 12 and 14 in their seats in nested relation and secures them in that position.

Referring in more detail to the body member 15 shown in FIGS. 5–8, the fingers 18 have relatively wide major portions 38 facing the side where they grip the second conductor 14, and are provided with reinforcing ribs 40 on the reverse side. About midway along the vertical length of the fingers 18, the wide major portions 38 are provided with steps 42 that increase the spacing between the fingers 18. The narrow spacing between the fingers 18 in the regions below the steps 42 is sufficient to clear the cross pieces 23 and 25 of the nesting member 22 and the larger size conductor, such as the first conductor 12, which is to be accommodated, but it will not clear the width of the wedge member 28. The wider spacing between the fingers 18 in the regions above the steps 42 is sufficient to clear the width of the wedge member 28, and the steps 42 may serve as supports or rests for the wedge member 28.

The underside of the yoke section 20 is flat, and in the surface regions where it meets the fingers 18 the yoke section 20 is grooved to provide two parallel slideways or tracks 44 for guiding the wedge member 28. The plane of tracks 44 makes an angle of less than 90° with the major vertical extension of the fingers 18 as viewed in FIG. 6. With respect to the horizontal, the tracks 44, the steps 42, and the axis of the threaded bore 34 are all similarly inclined, as shown.

At the rear of the yoke section 20 there is provided a recess 46 that extends approximately half way along the tracks 44. The width of the recess 46 is sufficient to clear the width of the collar 30 on the wedge member 28.

Figure 9:
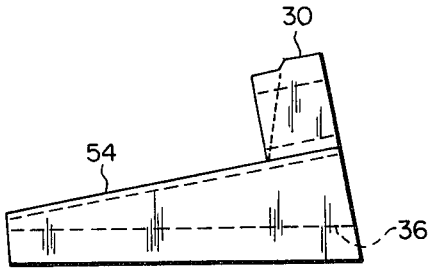
FIG. 9 is a side view of the wedge member.
Figure 10:
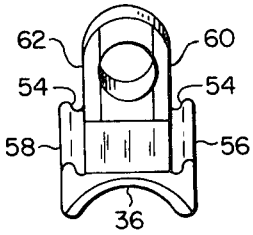
FIG. 10 is an end view of the wedge member.

Referring now in more detail to the wedge member 28 shown in FIGS. 9 and 10, the upper surface, which is relatively flat except for the collar 30, is formed with a pair of parallel extending, outwardly located runners 54. The runners 54 of the wedge member 28 slide along and are guided by the tracks 44 of the yoke section 20. The bottom side of the wedge member 28 has the curved portion 35 extending the length thereof. The runners 54 are inclined relative to the curved portion 36. The opposing side surfaces 56 and 58 of the wedge member 28 are machined flat and mutually parallel for clearing the space between the fingers 18 of the body member 15. Also, the opposing side surfaces 60 and 52 of the collar 30 are machined flat and mutually parallel so as to clear the recess 46 at the rear of the yoke section 20.

Figure 11:
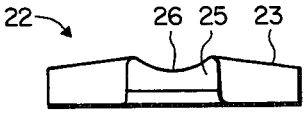
FIGS. 11 and 12 are front and side views, respectively, of one form of nesting member according to the invention.
Figure 12:
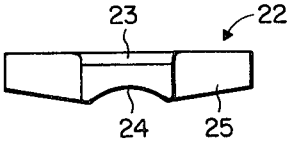

The nesting member 22 shown in FIGS. 3, 11 and 12 has a single curved seating surface 26 extending the length of the one side of the cross-piece 25 and a single curved seating surface 24 extending the length of the opposite side of the other cross-piece 23.

Figure 13:
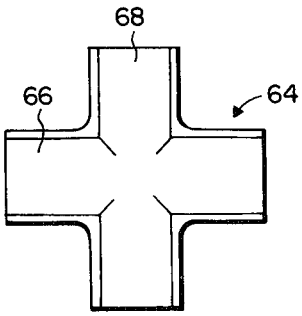
FIGS. 13, 14 and 15 are top, side, and front views, respectively, of an alternate form of nesting member according to the invention.
Figure 14:
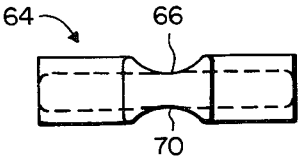
Figure 15:
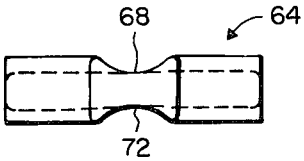

An alternate form of nesting member 65 is shown in FIGS. 13–15 which has crossing curved seating surfaces on both sides. The nesting member 64 is simpler for a workman to insert because it will fit the two conductors 12 and 14 in any one of its eight different positions. Thus, concave longitudinally extending seating surfaces 66 and 68 cross each other on one side, and concave longitudinally extending seating surfaces 70 and 72 cross each other on the side of the nesting member 64.

A simple procedure for installing the connector of the investion will now be described. First, the wedge member 28 and the bolt 32 are loosely assembled on the body member 15, with the both 32 screwed only part way into the yoke section 20. The body member 15 is placed over the upper conductor 12 so that the latter is straddled by the fingers 18, and then the body member 16 is brought down so that as the bottom of the wedge member 28 is pressed against the upper conductor 12, the lower ends of the fingers 18 are hooked onto the lower conductor 14. While the two conductors 12 and 14 are spread apart the nesting member 22 or 64 is lodged between them. Then, to provide preliminary clamping of the assembled connector and nested conductor, the wedge is pushed finger tight into the opening under the yoke. Thereafter, the bolt 32 is tightened until the conductors 12 and 14 are secured within the connector 10.

Finally, if the bolt 32 is of the type having a breakaway hexagonal head 74, as shown in FIG. 1, the head 74 will shear off when a predetermined amount of torque is exceeded, leaving a round head 76 to hold the bolt 32 secure.

The body member 16, wedge member 28, and nesting member 22 may each be made of aluminum bronze alloy, and the bolt 32 may be made of silicon bronze.

For the body member 15 and wedge member 28, an alloy known in the trade as CDA 954 is preferred, whereas for the nesting member CDA 833 is found suitable, and for the bolt CDA 651 or 655.

Some of the advantages afforded by the connector according to the invention are its simplicity in construction and minimum numbers of parts. No special installation tools are required other than a simple wrench, thereby permitting easy installation by hand of a single workman. The wedge member transmits a multiplied force on the conductors relative to the force directed along the bolt axis. Connection is afforded between conductors which are non-parallel and which lie in different planes.

What is claimed is:

1. A connector for joining two conductors extending transversely one another, comprising:

(a) a body member including a pair of fingers openly spaced apart at one end for straddling a first conductor extending in a given direction between said fingers and having seating surfaces at said one end suitably shaped for grasping a second conductor at spaced locations therealong extending transversely of said first conductor, and a yoke section joining said fingers at the other end thereof;

(b) a nesting member formed with at least two opposing seating surfaces extending transversely of one another and adapted to be positioned between said conductors so that a lower one of said seating surfaces cooperates with said fingers to grip said second conductor therebetween and the upper one of said seating surfaces forms a seat for said first conductor;

(c) an elongated wedge member adapted to be positioned beneath said yoke section between said fingers, and over a portion of the length of said first conductor, and provided with a suitably shaped undersurface which cooperates with the upper seating of said nesting member to grip said first conductor therebetween; and (d) means for coupling said wedge member to said yoke section for relative movement therebetween, such that when said first conductor is positioned between the upper seating surface of said nesting member and the undersurface of said wedge member, and said second conductor is positioned between the fingers of said body member and the lower seating surface of said nesting member, said wedge member can be driven in the space between said yoke section and said first conductor so as to secure both said conductors in nested relation.

2. The invention according to claim 1, where the fingers of said body member in (a) are provided with curved hook-like ends for grasping said second conductor.

3. The invention according to claim 1, wherein said body member in (a) is generally C-shaped and wherein said fingers have a relatively wide major portion facing the side where they grasp the second conductor and have relatively narrow reinforcing ribs on the reverse side thereof.

4. The invention according to claim 1, wherein the bottom side of said yoke section in (a) is provided with a pair of parallel tracks for guiding said wedge member, and said wedge member in (c) is provided with a pair of runners for engaging the tracks of said yoke section.

5. The invention according to claim 1, wherein the wedge member in (c) has a longitudinally extending under-surface that is curved concave.

6. The invention according to claim 5, wherein said wedge member has a relatively flat major portion of its upper surface formed to provide runners for engaging complementary tracks on said yoke section.

7. The invention according to claim 6, wherein the upper surface of said wedge member is inclined relative to the undersurface thereof.

8. The invention according to claim 7, wherein said wedge member is provided with a collar projecting from an end region of the upper surface thereof, said collar serving to receive a bolt for suspending said wedge member from said yoke section.

9. The invention according to claim 8, wherein the means in (d) comprises a threaded bolt extending through the collar of said wedge member, and said yoke section in (a) is provided with a threaded bore for receiving said bolt.

10. The invention according to claim 1, wherein the nesting member in (b) is provided with at least two opposing seating surfaces that cross perpendicularly and form cylindrical depressions.

11. The invention according to claim 10, wherein each side of said nesting member is formed with two crossing cylindrical depressions.

12. The invention according to claim 11, wherein said nesting member is shaped in the form of a cross.

* * * * *